US006877917B2

(12) United States Patent
Hoshino et al.

(10) Patent No.: US 6,877,917 B2
(45) Date of Patent: Apr. 12, 2005

(54) PRINTER APPARATUS FOR THERMOSENSITIVE ADHESIVE SHEET

(75) Inventors: Minoru Hoshino, Chiba (JP); Yoshinori Sato, Chiba (JP); Shinichi Yoshida, Chiba (JP); Masanori Takahashi, Chiba (JP)

(73) Assignee: SII P & S Inc., Chiba (JP)

( * ) Notice: Subject to any disclaimer, the term of this patent is extended or adjusted under 35 U.S.C. 154(b) by 0 days.

(21) Appl. No.: 10/659,504

(22) Filed: Sep. 10, 2003

(65) Prior Publication Data

US 2004/0081500 A1 Apr. 29, 2004

(30) Foreign Application Priority Data

Sep. 25, 2002 (JP) ..... 2002-279013

(51) Int. Cl.[7] ..... B41J 2/315

(52) U.S. Cl. ..... 400/120.01; 347/101; 347/171; 347/212; 347/218; 347/221

(58) Field of Search ..... 347/101, 171, 347/218, 221, 212; 400/120.01

(56) References Cited

U.S. PATENT DOCUMENTS 4,745,431 A * 5/1988 Kogure et al. ..... 399/69
6,031,553 A 2/2000 Nagamoto et al. ..... 347/171
6,172,698 B1 * 1/2001 Iwata et al. ..... 347/171
6,501,495 B1 * 12/2002 Ichikawa et al. ..... 347/171
2003/0068571 A1 * 4/2003 Uehara et al. ..... 430/126
2003/0160850 A1 * 8/2003 Ohya et al. ..... 347/101

FOREIGN PATENT DOCUMENTS

EP 0788972 8/1997

* cited by examiner

*Primary Examiner*—Andrew H. Hirshfeld
*Assistant Examiner*—Kevin D. Williams
(74) *Attorney, Agent, or Firm*—Adams & Wilks

(57) ABSTRACT

A printer apparatus has a printing device for printing on a printable layer of a thermosensitive adhesive sheet. A heat-application and transporting member heats a thermosensitive adhesive layer of the thermosensitive adhesive sheet and transports the thermosensitive adhesive sheet. A control device controls the heat-application and transporting member to heat a portion of the thermosensitive adhesive layer of the thermosensitive adhesive sheet while simultaneously controlling the printing device to print on a portion of the printable layer of the thermosensitive adhesive sheet disposed opposite to and generally confronting the portion of the thermosensitive adhesive layer of the thermosensitive adhesive sheet.

20 Claims, 4 Drawing Sheets

PRINTER APPARATUS FOR THERMOSENSITIVE ADHESIVE SHEET

BACKGROUND OF THE INVENTION

1. Field of the Invention

The present invention relates to a printer apparatus for printing of a thermosensitive adhesive sheet (hereinafter "thermosensible adhering sheet") formed with a thermosensitive adhesive layer showing a nonadhering property in normal time and manifesting an adhering property by being heated on one face of a sheet-like base member.

2. Description of the Related Art

In recent years, a label pasted on a commodity and used for a bar code, price indication or the like is frequently of a type having a pressure sensitive adhesive layer on a rear side of a record face (print face) and storing in a state of pasting an exfoliating sheet (separator) thereon to tackedly adhere thereto. However, the pasting label of this type needs to exfoliate the exfoliating sheet from the pressure sensitive adhesive layer when used as the label and therefore, there is a drawback of necessarily bringing about waste.

Hence, as a system for dispensing with the exfoliating sheet, there has been developed a thermosensible adhering label provided with a thermosensible adhesive layer showing a nonadhering property in normal time and manifesting an adhering property by being heated on a rear face side of a label-like base member and used for various uses. Further, there has also been promoted a development with regard to a thermally activating apparatus and a thermally activating method for heating a thermosensible adhesive layer of a thermosensible adhering label. For example, a thermally activating apparatus or the like utilizing a thermal head as heating means for thermally activating a thermosensible adhesive layer is disclosed in JP-A-11-79152.

FIG. 6 is a total view showing an outline constitution of a printer apparatus described in JP-11-79152. A thermal printer apparatus 100 of FIG. 6 is constituted by a roll containing unit 101 for holding a thermosensible adhering label L in a tape-like shape wound in a roll-like shape, a printing unit 110 for printing the thermosensible adhering label L, a cutter unit 120 for cutting the thermosensible adhering label L in a predetermined length, and a thermally activating unit 130 as a thermally activating apparatus for thermally activating a thermosensible adhesive layer of the thermosensible adhering label L.

Specifically, the printing unit 110 is provided with a thermal head 111 having a plurality of heat generating elements (resistance members) 113 arranged in width direction of the thermosensible adhering label L to be able to carry out dot printing, a printing platen roll 112 which is brought into pressure contact with the printing thermal head 111 and the like. Further, the cutter unit 120 is provided with a movable blade 121 operated by a drive source (not illustrated) of an electric motor or the like, a fixed blade 122 arranged to be opposed to the movable blade 121 and the like. Further, the thermally activating unit 130 is provided with a thermally activating thermal head 131 as heating means having a heat generating element 133, a thermally activating platen roll 132 as carrying means for carrying the thermosensible adhering label L and the like.

In the thermal printer apparatus 100, based on control signal transmitted from a CPU (not illustrated), respective processes are successively executed such that desired printing is executed at the printing unit 110, a cutting operation is executed by the cutter unit 120 at a predetermined timing and thermal activation is executed by the thermally activating unit 130 by applying predetermined energy.

Further, although as the thermally activating means of the thermosensible adhering label there have been proposed various methods such as a method of using hot wind or infrared ray, a method of using an electric heater or a dielectric coil and the like other than utilizing the above-described thermal head, all of the methods are the same in that the thermally activating unit is provided separately from the printing unit and the thermally activating processing of the thermosensible adhesive layer is carried out after printing the thermosensible adhering label.

Meanwhile, there has been proposed in JP-A-4-128121 a technology utilizing a heating roll as thermally activating means for a thermosensible adhering label although it is not directed to a thermally activating means of a printer apparatus for a thermosensible adhering label.

A label pasting apparatus disclosed in JP-A-4-128121 is an apparatus for thermally activating a thermosensible adhesive layer in a state of laminating a leaf member (postcard or the like) and the thermosensible adhering label by heating the thermosensible adhesive layer form a side opposed to a face of the thermosensible adhering label formed with the thermosensible adhesive layer by a heating roll to heat to bring the label into press contact with the leaf member. That is, the thermosensitive adhesive layer which is thermally activated by the heating roll is immediately brought into pressure contact with the leaf member when thermally activated and, therefore, heating control is comparatively easy.

However, when the heating roll is used as the thermally activating means of a printing apparatus for a thermosensible adhering label, there is a concern that when a thermosensible adhering label is heated at a face thereof on a side opposed to a side formed with the thermosensible adhesive layer, that is, a printable face thereof, the printable face develops a color and printing becomes unclear and there is a drawback that since the thermosensible adhesive layer is indirectly heated, the heating roll is obliged to heat at high temperature more than necessary and the efficiency is poor. Further, when the heating roll and the thermosensible adhesive layer are brought into direct contact with each other to thermally activate, there is a concern of adhering the thermosensible adhesive layer to the heating roll. From such reason, the heating roll is not generally used as the thermal activating means of the printer apparatus for the thermosensible adhering label.

Meanwhile, there is frequently a case in which a thermosensible adhering label is utilized for use for indicating price of a commodity or the like and, therefore, as the printer for printing the thermosensible adhering label, a printer apparatus excellent in portability is desired. However according to the conventional printer apparatus shown in JP-A-11-79152, the printing unit and the thermally activating unit are separately provided and, therefore, a space for installing these units is required which makes reduction in size of the printer apparatus difficult to achieve.

SUMMARY OF THE INVENTION

It is an object of the invention to provide a printer apparatus for a thermosensible adhering sheet capable of realizing small-sized formation/light-weighted formation and capable of shortening a time period required for printing processing/thermally activating processing.

The invention has been carried out in order to achieve the above-described object and is a printer apparatus for a thermosensible adhering sheet, the printer apparatus comprising printing means for printing a printable face of a thermosensible adhering sheet constituted by forming a thermosensible adhesive layer on other face of a sheet-like base member having the printable face on one face thereof, carrying means arranged to be opposed to the printing means for carrying the thermosensible adhering sheet in a predetermined direction, and controlling means for carrying out a control when the thermosensible adhering sheet is subjected to a printing processing and a thermally activating processing, wherein the carrying means includes thermally activating means for heating the thermosensible adhesive layer to thermally activate, and the controlling means subjects the thermosensible adhesive layer to the thermally activating processing by controlling the thermally activating means while subjecting the printable face to the printing processing by controlling the printing means.

Thereby, the thermosensible adhering sheet is carried and thermally activated by the carrying means and therefore, the thermally activating unit which has been conventionally provided exclusively for the thermally activating processing is not needed. Therefore, a space and a member for the thermally activating unit can be omitted and therefore, small-sized formation/light-weighted formation of the printer apparatus can be achieved and apparatus cost can be reduced.

Further, the constitution of the printer apparatus is made simpler than the conventional constitution and therefore, a rate of bringing about a failure in carrying a label such as sheet jamming which is liable to bring about at a vicinity of an inserting port or a discharge port can be reduced. Further, the printing processing and the thermally activating processing can simultaneously be carried out and therefore, the speed of forming print sheet can be improved.

Further, the carrying means includes a shaft made of a metal (for example, a shaft made of aluminum) having a hollow portion and a halogen lamp arranged at the hollow portion of the shaft. The halogen lamp is characterized in high safety and long service life and therefore, the reliability of the printer apparatus can be promoted.

Further, an outer peripheral face of the carrying means is coated with a silicon species resin or a fluorine species resin. Thereby, print quality or thermally activating efficiency can be prevented from deteriorating by adhering the thermally activated thermosensible adhesive layer to the outer peripheral face of the carrying means.

Further, a temperature measuring sensor for measuring a surface temperature of the carrying means is provided and the controlling means controls the thermally activating means based on a measured result by the temperature measuring sensor. Thereby, the surface temperature of the carrying means can accurately be controlled and therefore, the thermosensible adhesive layer can be subjected to desired thermally activating processing. For example, when a halogen lamp is utilized as the thermally activating means, electricity is controlled to conduct based on the measured result of the temperature measuring sensor.

Further, the carrying means is attached to a main body frame via an insulating member. Thereby, not only the thermal efficiency can be promoted by restraining heat radiation from the carrying means but also the main body frame can be prevented from deforming or deteriorating by influence of heat from the carrying means.

Further, the invention is effectively applied to a thermal printer using a thermal head constituted by arranging a plurality of heat generating elements which can be controlled to conduct electricity individually in a column-like shape as printing means, which is widely utilized as a label printer apparatus.

BRIEF DESCRIPTION OF THE DRAWINGS

For a more better understanding of the present invention, reference is made of a detailed description to be read in conjunction with the accompanying drawings, in which.

DETAILED DESCRIPTION OF THE PREFERED EMBODIMENT

Preferred embodiments of the invention will be explained in details in reference to the drawings as follows.

Figure 1:
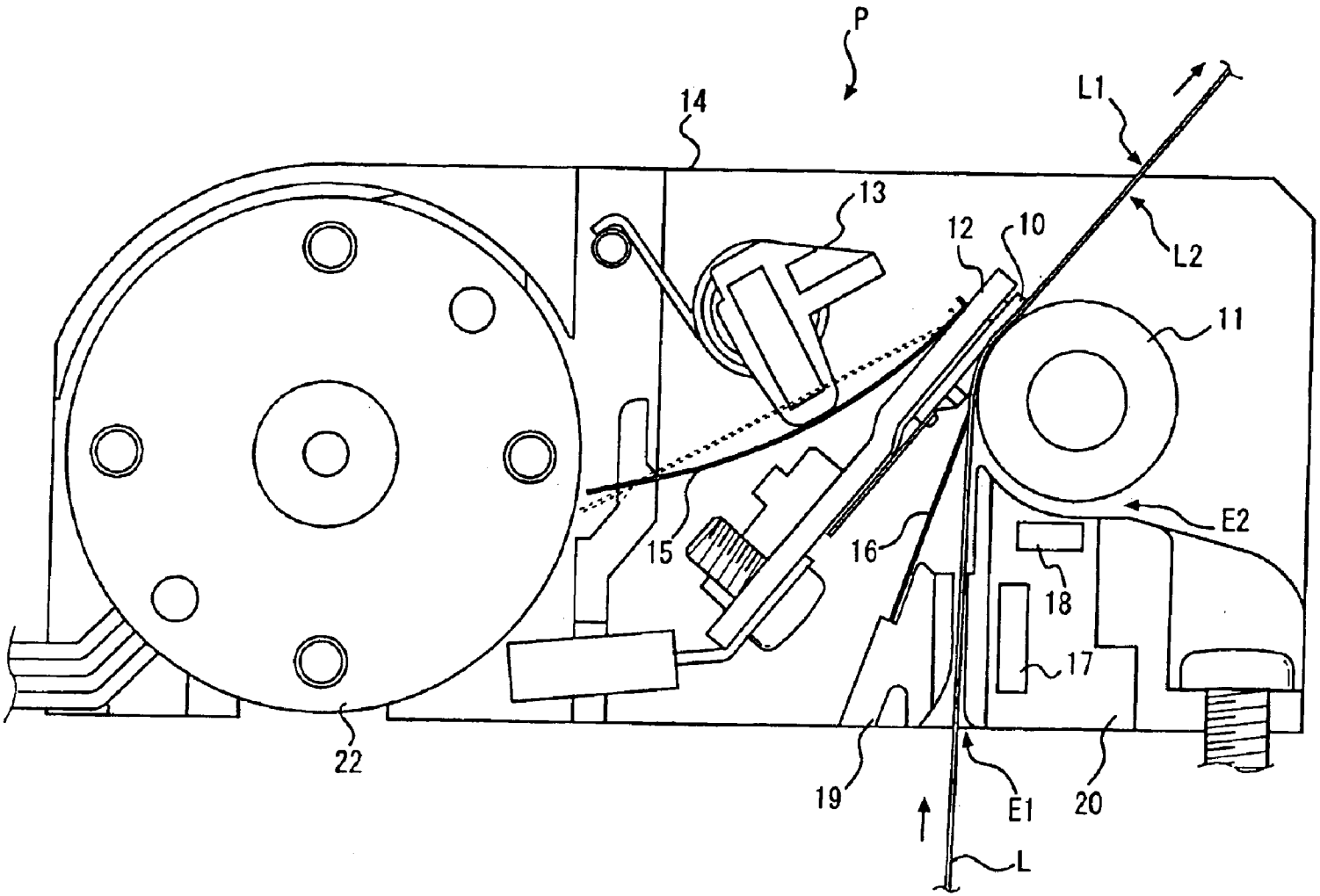
FIG. 1 is an outline view showing a constitution example of a printing unit P of a thermal printer apparatus according to the invention.

FIG. 1 is a sectional view showing an outline constitution of a printing unit P of a thermal printer apparatus according to the invention.

The printing unit P is provided with a thermal head 10 having a plurality of heat generating elements (resistance members) arranged in a width direction of a thermosensitive adhesive label (hereinafter "thermosensible adhering label") L to be able to carry out dot printing and a platen roller (hereinafter "platen roll") 11 as carrying mean and thermally activating means which is brought into press contact with the thermal head 10 while a printing process and a thermally activating process are simultaneously carried out in a state of interposing the thermosensible adhering label L therebetween. Thus, as further described below, the platen roll 11 constitutes heat-application and transporting means for heating a thermosensible adhering layer of the thermosensible adhering label L and for transporting the thermosensible adhering label L.

The thermal head 10 is installed at a front end of a heat radiating plate 12 supported by a head bearing, not illustrated, and the thermal head 10 is constituted to be able to approach and separate from the platen roll 11 by axially supporting the head bearing by a frame 14. Further, a leaf spring 15 is arranged at a back face of the heat radiating plate 12, by a pressing cam 13 attached pivotably to the frame 14 of the thermal printer apparatus, the leaf spring 15 is pressed to the platen roll 11 and the thermal head 10 is brought into press contact with the platen roll 11 by spring force thereof. At this occasion, by maintaining a rotating shaft of the platen roll 11 and a direction of aligning the heat generating elements in parallel with each other, the press contact can be carried out uniformly over a total of the thermosensible adhering label L in the width direction.

Further, the thermal head 10 is constructed by a constitution similar to that of a printing head of a publicly-known thermal printer apparatus constituted by providing protective films of glass-ceramics on surfaces of a plurality of heat generating elements arranged on a ceramic board and therefore, a detailed explanation thereof will be omitted.

The platen roll 11 is rotated by a stepping motor 22 and a gear transmission mechanism (not illustrated) provided at the side portion of the frame 14 in a predetermined direction (clockwise direction in FIG. 1) in cooperation with rotation of the stepping motor 22. Further, the platen roll 11 of the embodiment includes, for examples, a halogen lamp as thermally activating means at inside thereof and can carry the thermosensible adhering label L and thermally activate the thermosensible adhering label L at desired temperature.

Further, the thermal printer apparatus is provided with guide members 19 and 20 and a gap between the guide members 19 and 20 is made to constitute an inserting port E1 of the thermosensible adhering label L. Meanwhile, a gap is provided also between an upper face of the guide member 20 and the platen roll 11 to constitute an inserting port E2 of the label L. Further, the inserting ports E1 and E2 are properly used by a kind and a thickness of the thermosensible adhering label.

Further, the guide member 19 is provided with a plate-like member 16 for guiding the thermosensible adhering label L to the platen roll 11. By making the thermosensible adhering label L reach a predetermined position of the platen roll 11 by the plate-like member 16, the thermosensible adhering label L and the platen roll 11 can be brought into contact with each other over a predetermined range and therefore, the thermosensible adhering label can thermally be activated comparatively efficiently. Further, label detection sensors 17 and 18 for detecting the thermosensible adhering label L are provided at inside of the guide member 20. Based on detection of the label L by the label detection sensors 17 and 18, the platen roll 11 starts rotating and a timing of heating the thermal head 10 and the platen roll 11 is controlled.

Although the thermosensible adhering label L used in the embodiment is not particularly restricted here, the thermosensible adhering label L is constituted by, for example, a structure in which a surface side of a label base member is formed with a thermosensible color developing layer (printable face) and a rear face side thereof is formed with a thermosensible adhesive layer constituted by coating and drying a thermosensible adhesive. Further, it is preferable to provide a heat insulating layer on the surface side of the label base member (between the base member and the thermosensible color developing layer) such that printing quality is not deteriorated by effecting influence on the printable face L1 by heat from the platen roll 11.

Further, in forming the thermosensible adhesive layer, a thermosensible adhesive whose major component is a thermo-plastic resin, a solid plastic resin or the like may be used. Further, the thermosensible adhering label L may be provided with a protective layer or a colored printing layer (previously printed layer) at a surface of the thermosensible color developing layer.

Figure 2:
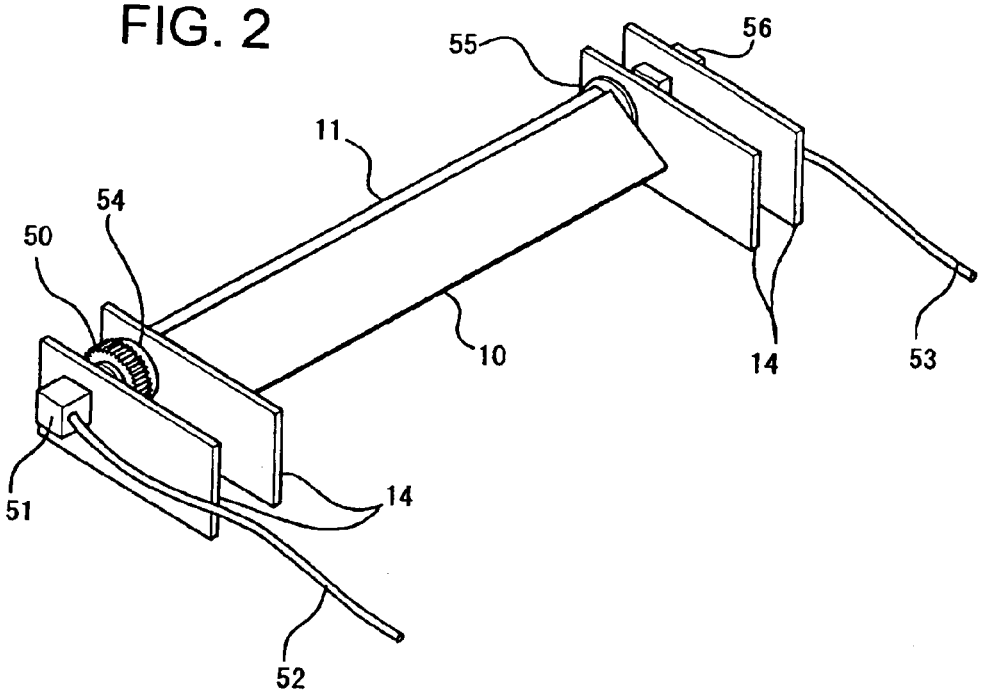
FIG. 2 is a perspective view showing a state of attaching a platen roll 11 to a main body frame 14.
Figure 3:
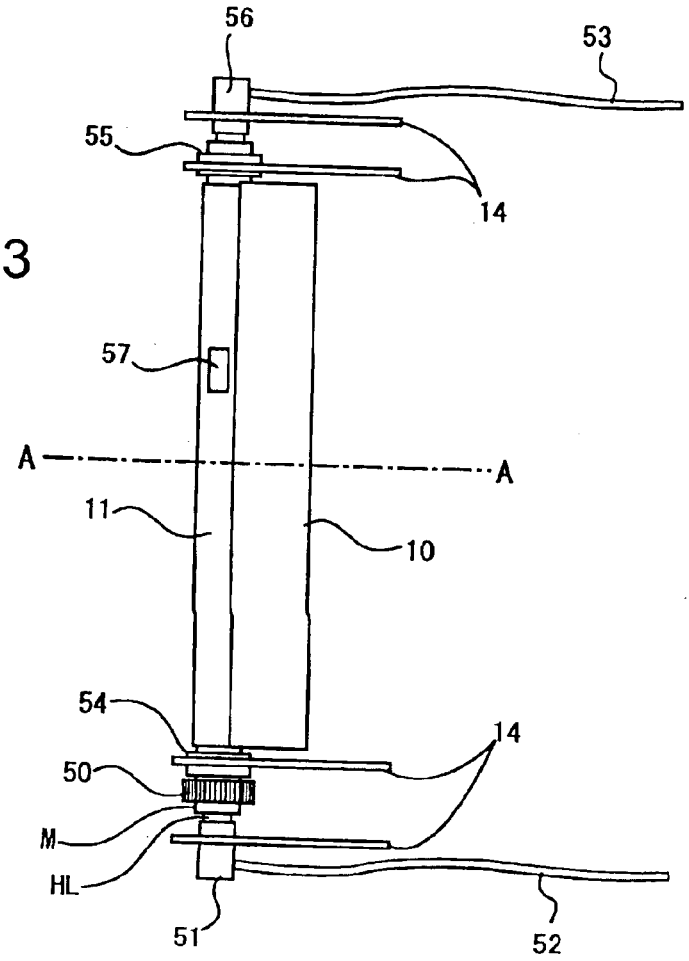
FIG. 3 is a top view showing the state of attaching the platen roll 11 to the main body frame 14.
Figure 4:
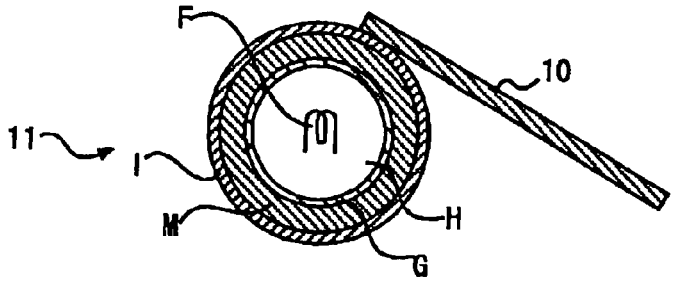
FIG. 4 is a sectional view taken along a line A—A of FIG. 3 showing an outline constitution of the platen roll 11.

Next, the platen roll 11 constituting the printer apparatus of the embodiment will be explained in reference to FIG. 2 through FIG. 4. FIG. 2 is a perspective view showing a state of attaching the platen roll 11 and FIG. 3 is a top view thereof. Further, FIG. 4 is a sectional view taken along a line A—A of FIG. 3 showing an outline constitution of the platen roll 11.

The platen roll 11 includes a heater comprising a halogen lamp at inside thereof to thermally activate the thermosensible adhesive layer L2 of the thermosensible adhering label L. As shown by FIG. 4, a base member thereof is constituted by a shaft M made of aluminum or made of other metal having a hollow portion of, for example, 9 mm and a halogen lamp HL is inserted into the hollow portion. Meanwhile, an outer peripheral face of the shaft M made of metal is formed with a silicon species resin or fluorine species resin layer for preventing the thermosensible adhesive on the surface of the thermally activated label from exfoliating to adhere thereto.

Here, as the halogen lamp HL, a publicly-known halogen lamp utilized as the heating heater can be used. For example, as shown by FIG. 4, the halogen lamp HL may be constructed by a constitution in which a tungsten filament F is arranged at inside of a glass tube G and a small amount of a halogen substance of iodine, bromine, chlorine or the like is filled at inside of the glass tube G along with an inert gas of nitrogen, argon or the like. Further, it is preferable to constitute the glass tube G by heat resistant glass of quartz glass or the like.

Further, heat insulting holding members 51 and 56 are formed at end portions of the halogen lamp HL exposed from both ends of the shaft M made of metal and lead wires 52 and 53 are connected to the both ends of the halogen lamp HL via the holding members 51 and 56. Other ends of the lead wires 52 and 53 are connected to a power source apparatus and electricity is conducted to the halogen lamp HL by the power source apparatus.

The platen roll 11 having the above-described constitution is attached to the main body frame 14 via heat insulating bearing members 54 and 55 and the holding members 51 and 56 at the both ends and pivotably held thereby. By constituting the bearing members 54 and 55 and the holding members 51 and 56 by the heat insulating material in this way, thermal efficiency is promoted by restraining heat radiation from the platen roll 11 and the main body frame is prevented from being deformed or defeteriorated by receiving the influence of heat.

Further, a gear 50 disposed between the bearing member 54 and the holding member 51 is provided at one of the end portions of the platen roll 11 and is connected to the stepping motor 22 by a gear train (not illustrated).

Further, a temperature sensor 57 is brought into contact with the surface of the platen roll 11 and CPU, mentioned later, is constituted to control to conduct electricity to the halogen lamp HL based on temperature detected by the temperature sensor 57.

In this way, according to the print apparatus of the embodiment, the thermosensible adhering label L is carried and thermally activated by the platen roll 11 and, therefore, a thermally activating unit provided exclusively for the thermally activating process in the conventional art is not needed. Therefore, a space as well as a member for the thermally activating unit can be omitted and, therefore, reduction in size and weight of the printer apparatus can be achieved and the cost of the apparatus can be reduced.

Figure 5:
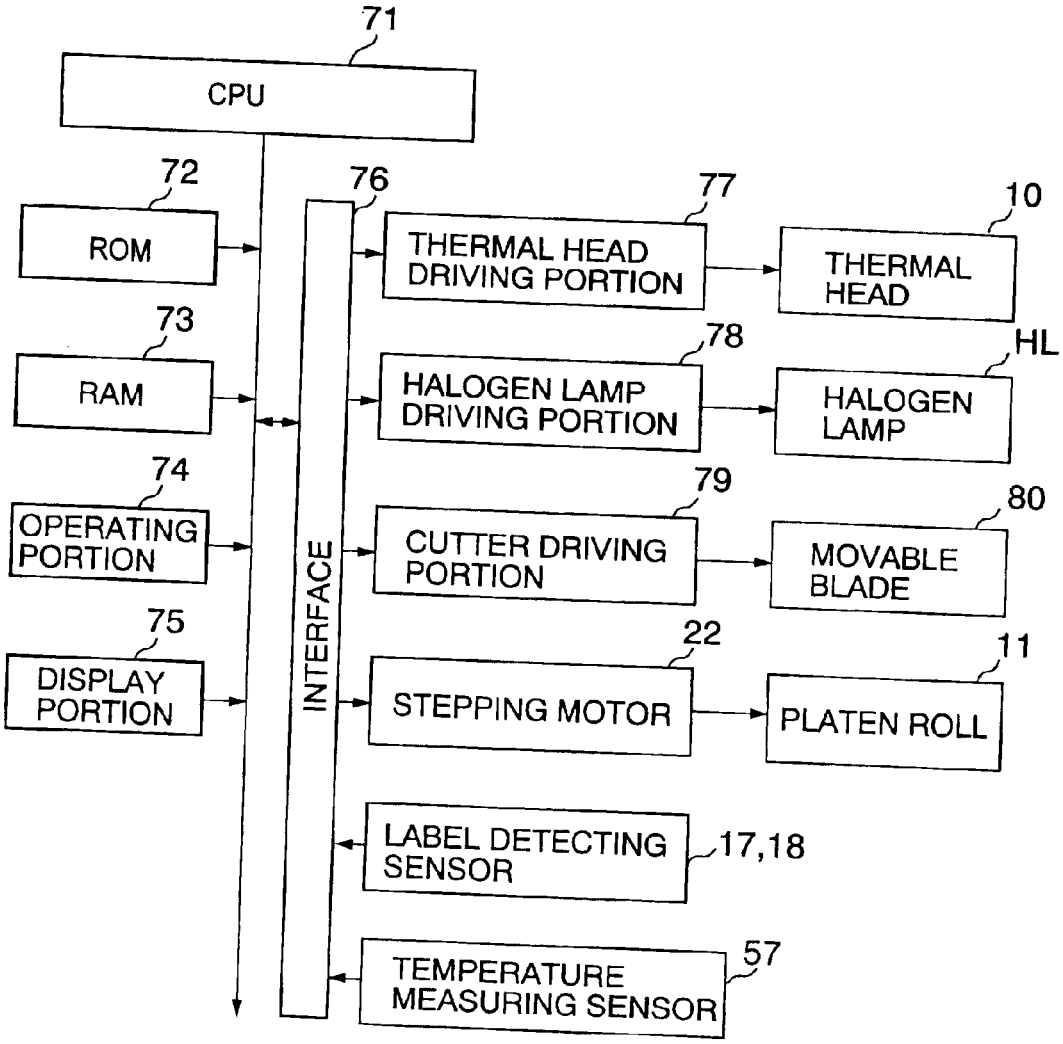
FIG. 5 is a control block diagram of the thermal printer apparatus according to the embodiment.
Figure 6:
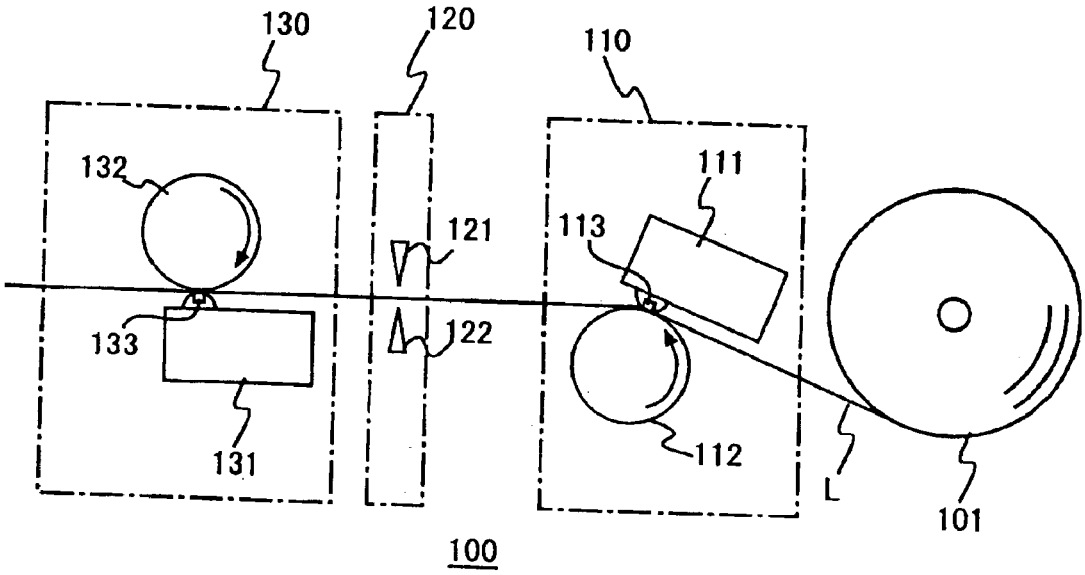
FIG. 6 PRIOR ART
FIG. 6 is a total view showing an outline constitution of a conventional printer apparatus.

FIG. 5 is a control block diagram of the thermal printer apparatus of the embodiment. A control portion of the printer apparatus is constituted by CPU 71 functioning as controlling means for governing the control portion, ROM 72 for storing control programs and the like executed by CPU 71, RAM 73 for storing various print formats and the like, an operating portion 74 for inputting, setting or calling print data, print format data and the like, a display portion 75 for displaying print data and the like, an interface 76 for inputting and outputting data between the control portion and driving portions, a driving circuit 77 for driving the OLE_LINK1 thermal head 10, a driving circuit 78 for driving the halogen lamp HL at inside of the OLE_LINK1 platen roll 11, a driving circuit 79 for driving a movable blade 80 for cutting the thermosensible adhering label L, the stepping motor 22 for driving to rotate the platen roll 11, the label detecting sensors 17, 18 for directing presence or absence of the thermosensible adhering label L, and the temperature measuring sensor 57 for measuring surface temperature of the platen roll 11.

CPU 71 as controlling means controls operation of the thermal head driving portion 77, the stepping motor 22 and the cutter driving portion 79 based on inputted print data. Further, CPU 71 controls to conduct electricity to the halogen lamp HL at inside of the platen roll 11 to constitute predetermined temperature based on the surface temperature of the platen roll 11 measured by the temperature measuring sensor 57.

An explanation will be given of printing/thermally activating processings using the printer apparatus of the embodiment as follows.

First, the thermosensible adhering label L is transmitted from a label holding unit (not illustrated) and inserted into the printing unit 10 from the inserting port E1 (or E2). Further, when the thermosensible adhering label L is detected by the label detecting sensor 17 (or 18), the platen roll 11 is started to be driven to rotate base thereon and after the thermosensible adhering label L reaches the platen roll 11 by being guided by the plate-like member 16, the label L is carried by the platen roll 11.

Next, the thermosensible color developing layer L1 of the thermosensible adhering label L is thermosensibly printed by the thermal head 10 and at the same time, the thermosensible adhesive layer L2 is thermally activated by the platen roll 11.

Here, electricity has previously started to conduct to the halogen lamp HL at inside of the platen roll 11 (for example, immediately after switching on power source of the printer apparatus) to thereby elevate the temperature thereof to thermally activate the temperature of the thermosensible adhesive layer before arrival of the thermosensible adhering label L. Further, the thermosensible adhering label L is brought into contact with the platen roll 11 since the thermosensible adhering label L has reached the platen roll 11 until the thermosensible adhering L is printed by the thermal head 10 and therefore, during the time period, the thermally activating processing can be carried out to thereby enable to thermally activate the label L efficiently.

Thereafter, after carrying the thermosensible adhering label L to a cutter unit (not illustrated) by rotating the platen roll 11, the thermosensible adhering label L is cut to a predetermined length by the movable blade 80 operated at a predetermined timing to thereby finish a series of the printing processing and the thermal activating processing.

According to the printer apparatus for the thermosensible adhering sheet of the embodiment, the constitution becomes simpler than that of the conventional printer apparatus by dispensing with the thermally activating unit and therefore, a failure in carrying the label such as sheet jamming which is liable to bring about at the vicinity of the discharge port becomes difficult to be brought about. Further, the printing processing and the thermally activating processing can simultaneously be carried out and therefore, speed of forming print sheet can be improved.

Although a specific explanation has been given of the invention which is carried out by the inventors based on the embodiment as described above, the invention is not limited to the embodiment described but can be modified in various ways without departing from the spirit and scope of the invention.

For example, although according to the embodiment, the platen roll 11 is provided with the function as the thermally activating means by using the halogen lamp HL, in place of the halogen lamp, an infrared ray lamp or a ceramic heater may be used. Further, heat may be generated by winding a nichrome wire or the like formed with an insulating film on an outer peripheral surface of a platen shaft in a rod-like shape and conducting electricity to the coil. Also in this case, it is preferable to coat to mold an outermost periphery thereof by a resin of rubber or the like. Further, a constitution referred to as heating roll which is utilized in a toner fixer or the like of a copier or the like conventionally can be utilized.

Further, although according to the embodiment, an explanation has been given of a constitution applied to a thermosensible type printing apparatus such as the thermal printer as an example, the invention is applicable to a printer apparatus of a thermally transcribing system, an ink jet system, or a laser print system. In that case, in place of the thermosensible color developing layer at the surface of the label, a label having a printable face fabricated to be suitable for the respective printing systems is used.

According to the invention, there is provided a printer apparatus for a thermosensible adhering sheet, the printer apparatus comprising printing means for printing a printable face of a thermosensible adhering sheet constituted by forming a thermosensible adhesive layer on other face of a sheet-like base member having the printable face on one face thereof, and carrying means arranged to be opposed to the printing means for carrying the thermosensible adhering sheet in a predetermined direction (platen roll) in which the carrying means includes thermally activating means for heating the thermosensible adhesive layer to thermally activate and therefore, the thermal activating unit which has been provided conventionally exclusively for the thermal activating processing is not needed. Therefore, a space as well as a member for the thermally activating unit can be omitted and therefore, there is achieved an effect of capable of achieving small-sized formation/light-weighted formation of the printer apparatus and capable of reducing apparatus cost.

Further, the constitution of the printer apparatus is simplified and, therefore, a rate of bringing about a failure in carrying a label such as sheet jamming which is liable to bring about at a vicinity of an inserting port or a discharge port of the unit can be reduced. Further, the printing process and the thermally activating process can simultaneously be carried out and, the speed of forming a print sheet can be improved.

What is claimed is:

1. A printer apparatus for printing on a thermosensitive adhesive sheet, the printer apparatus comprising:

printing means for printing on a printable layer of a thermosensitive adhesive sheet having a thermosensitive adhesive layer disposed opposite to the printable layer;

heat-application and transporting means for heating the thermosensitive adhesive layer of the thermosensitive adhesive sheet and for transporting the thermosensitive adhesive sheet; and control means for controlling the heat-application and transporting means to heat a portion of the thermosensitive adhesive layer of the thermosensitive adhesive sheet and to transport the thermosensitive adhesive sheet while simultaneously controlling the printing means to print on a portion of the printable layer of the thermosensitive adhesive sheet disposed opposite to and generally confronting the portion of the thermosensitive adhesive layer of the thermosensitive adhesive sheet.

2. A printer apparatus according to claim 1; wherein the heat-application and transporting means comprises a metal shaft having a hollow portion and a halogen lamp disposed in the hollow portion of the shaft.

3. A printer apparatus according to claim 1; wherein the heat-application and transporting means comprises a movable member having an outer peripheral surface coated with one of a silicon resin and a fluorine resin.

4. A printer apparatus according to claim 1; wherein the heat-application and transporting means comprises a movable member; and further comprising a temperature measuring sensor for measuring a surface temperature of the movable member, the control means including means for controlling the heat-application and transporting means to heat the thermosensitive adhesive layer of the thermosensitive adhesive sheet in accordance with the surface temperature of the movable member measured by the temperature measuring sensor.

5. A printer apparatus according to claim 1; further comprising a main body frame; and wherein the heat-application and transporting means is connected to the main body frame via an insulating member.

6. A printer apparatus according to claim 1; wherein the printing means comprises a thermal head having a plurality of heat generating elements; and wherein the control means includes means for individually controlling the heat generating elements to conduct electricity.

7. A printer apparatus according to claim 1; wherein the heat-application and transporting means comprises a platen roller having a hollow portion and an outer peripheral surface for contacting the thermosensitive adhesive layer of the thermosensitive adhesive sheet, and a heater disposed in the hollow portion of the platen roller for heating the outer peripheral surface of the roller.

8. A printer apparatus according to claim 7; wherein the printing means comprises a thermal head; and further comprising pressing means for pressing the thermal head into pressure contact with the outer peripheral surface of the platen roller with the thermosensitive adhesive sheet disposed therebetween.

9. A printer apparatus according to claim 1; wherein the printing means comprises a thermal head; and wherein the heat-application and transporting means comprises a platen roller for contacting the thermal head with the thermosensitive adhesive sheet disposed therebetween and means for heating the platen roller to heat the thermosensitive adhesive layer of the thermosensitive adhesive sheet.

10. A printer apparatus comprising:

a heat-application and transporting member for heating a thermosensitive adhesive layer disposed on a first surface of a thermosensitive adhesive sheet and for transporting the thermosensitive adhesive sheet;

printing means for printing on a second surface of the thermosensitive adhesive sheet disposed opposite the first surface thereof while the thermosensitive adhesive layer of the thermosensitive adhesive sheet is simultaneously heated by the heat-application and transporting member; and pressure-application means for bringing the printing means into pressure contact with the heat-application and transporting member with the thermosensitive adhesive sheet disposed therebetween.

11. A printing apparatus according to claim 10; wherein the heat-application and transporting member comprises a hollow metal member having an outer peripheral surface for contacting the thermosensitive adhesive layer of the thermosensitive adhesive sheet and a heating element disposed in the hollow metal shaft for heating the outer peripheral surface thereof.

12. A printing apparatus according to claim 11; wherein the hollow metal member comprises platen roller mounted for undergoing rotation to transport the thermosensitive adhesive sheet.

13. A printing apparatus according to claim 11; wherein the outer peripheral surface of the hollow metal member is coated with one of a silicon resin and a fluorine resin.

14. A printing apparatus according to claim 11; further comprising a temperature measuring sensor for measuring the temperature of the outer peripheral surface of the hollow metal member; and wherein the heat-application and transporting member heats the thermosensitive adhesive layer of the thermosensitive adhesive sheet in accordance with the temperature of the outer peripheral surface of the hollow metal member measured by the temperature measuring sensor.

15. A printer apparatus according to claim 10; further comprising a main body frame; and where n the heat-application and transporting member is connected to the main body frame via an insulating member.

16. A printer apparatus according to claim 10; wherein the pressure-application means comprises a spring member and a cam member mounted to undergo pivotal movement for pressing the spring member against the printing means to bring the printing means into pressure contact with the heat-application and transporting member with the thermosensitive adhesive sheet disposed therebetween.

17. In combination with a thermosensitive adhesive sheet having a printable surface and a thermosensitive adhesive surface disposed opposite to the printable surface, a printing apparatus comprising:

printing means for printing on the printable surface of the thermosensitive adhesive sheet during a printing operation; and a heat-application and transporting member disposed generally opposite to and confronting the printing means with the thermosensitive adhesive sheet disposed therebetween for heating the thermosensitive adhesive layer of the thermosensitive adhesive sheet and for transporting the thermosensitive adhesive sheet during a printing operation.

18. A printing apparatus according to claim 17; wherein the heat-application and transporting member comprises a hollow metal member having and outer peripheral surface for contacting the thermosensitive adhesive layer of the thermosensitive adhesive sheet and a heating element disposed in the hollow metal shaft for heating the outer peripheral surface thereof during a printing operation.

19. A printing apparatus according to claim 18; wherein the hollow metal member comprises platen roller mounted for undergoing rotation to transport the thermosensitive adhesive sheet.

20. A printing apparatus according to claim 18; wherein the outer peripheral surface of the hollow metal member is coated with one of a silicon resin and a fluorine resin.

* * * * *